United States Patent [19]

Hines

[11] Patent Number: 4,974,906

[45] Date of Patent: Dec. 4, 1990

[54] READY-TO-ASSEMBLE CHAIR

[76] Inventor: John D. Hines, 10-4 Hillcroft, R.B., Weatherford, Tex. 76087

[21] Appl. No.: 422,967

[22] Filed: Oct. 18, 1989

[51] Int. Cl.[5] ..... A47C 7/00

[52] U.S. Cl. ..... 297/440; 297/442

[58] Field of Search ..... 297/440, 441, 442, 443, 297/444

[56] References Cited

U.S. PATENT DOCUMENTS

| | | | |
|---|---|---|---|
| D. 51,884 | 3/1918 | Herhold . | |
| D. 183,606 | 9/1958 | Glass . | |
| D. 183,607 | 9/1958 | Glass . | |
| D. 184,238 | 1/1959 | Nelson et al. . | |
| 1,674,220 | 6/1928 | Pericival | 297/440 X |
| 1,718,321 | 6/1929 | Vericel | 297/440 |
| D. 1,836,079 | 9/1958 | Glass . | |
| 2,628,668 | 2/1953 | Basile . | |
| 3,407,001 | 10/1968 | Minsker . | |
| 4,324,433 | 4/1982 | Saiger . | |
| 4,577,906 | 3/1986 | Hsuing . | |

FOREIGN PATENT DOCUMENTS

| | | | |
|---|---|---|---|
| 2437809 | 6/1980 | France | 297/440 |
| 70264 | 1/1952 | Netherlands | 297/442 |
| 2151473 | 7/1985 | United Kingdom | 297/440. |
| 2154868 | 9/1985 | United Kingdom | 297/440 |

OTHER PUBLICATIONS

Chair made by Gunlocke Co., now in use at Hood County, Tex., Library.

*Primary Examiner*—Laurie K. Cranmer

*Attorney, Agent, or Firm*—Charles D. Gunter, Jr.

[57] ABSTRACT

An improved ready-to-assemble armless chair comprised of a pair of h-shaped frames interconnected with each other along their seat-supporting members to form an x-shaped frame. An intermediary plate serves to lock the two h-frames into a rigid assembly, and provides support for the seat member. From the horizontal backrest, which is attached to the chair's rear vertical members, is suspended a lower-back support fabricated from a flexible material. Removal of a single fastener frees the seat member for re-upholstery.

7 Claims, 2 Drawing Sheets

READY-TO-ASSEMBLE CHAIR

BACKGROUND—FIELD OF INVENTION

This invention relates to a chair, and more particularly to an armless ready-to-assemble (knock-down) chair which ships and stores flat.

BACKGROUND—DESCRIPTION OF PRIOR ART

Furniture manufacturers commonly assemble chairs at the factory prior to shipment to the buyer. Assembly is done at the source of manufacture because the assembly process generally requires specialized tools and skilled workmen.

Shipping, packaging and storage costs can be substantially reduced, however, when chairs are shipped and stored in an unassembled state. This is because the shape of the chair in its assembled form occupies a relatively large volume of space though the elements themselves take up a relatively small space.

Though the design of a ready-to-assemble chair may take one of many different configurations, the so-called x-frame design has been used with success because it is generally easy to assemble and less expensive to manufacture than the traditional rectangular frame, such as illustrated in U.S. Pat. No. 4,577,906 (Hsiung, 1986). The chair frame of my invention exemplifies the x-frame configuration, and further references to prior art in this application will be limited to chairs embodying the x-frame style of construction.

Although the ready-to-assemble concept clearly provides benefits to the manufacturer, distributor and end user, problems resulting from this style of design have become apparent. Some of these problems are:

(a) Because it is the end users—persons unskilled in furniture construction—who assemble ready-to-assemble chairs, the fasteners and joints must be very simple and may not require more than one or two commonly possessed tools, a screwdriver or pliers, for example. These minimal resources at the assembly stage require that the task of assembling the chair elements be simple enough for a layman to accomplish. Unfortunately, simple joints, particularly in wood construction, are too often joints that are weak. This results in ready-to-assemble chairs that are often unstable and unsafe. For example, in U.S. Pat. Design No. 184,238 to Nelson and Pile (1959), the thin wooden x-frame and backrail would appear to lack sufficient strength to hold up under prolonged or heavy use.

Likewise U.S. Pat. No. 2,628,668 to Basile (1953) shows an x-frame chair made of relatively thin plywood components, and U.S. Pat. No. 3,407,001 to Minsker (1968) shows a wood and plastic x-frame chair. Both chairs would appear to lack strength and stability when subjected to rigorous use.

Knock-down arm chair, U.S. Pat. No. 4,324,433 (Saiger, 1982) overcomes the inherent weakness often found in wood ready-to-assemble x-frame chairs through the use of all-metal components and exposed nut-and-bolt fasteners. Metal materials, however, do not satisfy that segment of the market which seeks the aesthetic satisfaction of all-wood chairs.

(b) The components of ready-to-assemble chairs are generally assembled using numerous screws and bolts, the heads of which are often clearly visible. This attribute is perceived by the buying public as the mark of an inferior product and detracts from the overall aesthetic qualities of the chair.

For example, four unsightly screw heads are clearly in view where the back is attached to the two back posts in Basile's chair (U.S. Pat. No. 2,628,668, FIG. 2). This is a problem that would seem to be common to all wooden armless x-frame chairs heretofore produced.

Herhold's bent stacking chair with x-frame bracing (U.S. Pat. No. 51,884, 1918) is another example of the problem of exposed screw heads.

(c) Lower back support in wooden x-frame chairs is generally non-existent (Basile, Nelson-Pile, and Glass, U.S. Pat. Design No. 183,607, 1958), or else it is rigid and unyielding (Herhold and Glass, U.S. Pat. Design No. 183,606).

(d) In some applications, particularly in commercial establishments such as restaurants and hotels, chair seats must be removed from time to time for re-upholstery. With conventional chair designs, removing the seat for renewal constitutes a major effort requiring the removal of several fasteners. In some cases, chair seats cannot be removed at all, thus assuring early obsolescence.

OBJECTS AND ADVANTAGES

Accordingly, several objects and advantages of my invention are:

(a) to provide a novel chair construction involving a combination of elements which may be quickly and easily assembled by an untrained end user, using a single type of tool.

(b) to provide a chair with a novel intermediary plate between the seat and the chair frame, which, when securely fastened, assures a chair which possesses a degree of strength and stability heretofore common only to factory-assembled wood chairs.

(c) to provide a ready-to-assemble chair in which the heads of screw fasteners are generally obscured if not completely hidden from view, thus making the assembled chair indiscernable from a factory-assembled chair.

(d) to provide a chair whose unassembled components comprise a compact unit for packaging, shipping and storage.

(e) to provide a chair with a novel flexible lower-back support that assures comfort through a combination of support and resiliency.

(f) to provide a chair whose seat may be removed for re-upholstery with the retraction of a single fastener.

Further objects and advantages are to provide a chair which is economical to manufacture and is of a pleasing appearance. Still further objects and advantages will become apparent from a consideration of the ensuing description and drawings.

Reference Numerals in Drawings

Figure 1:
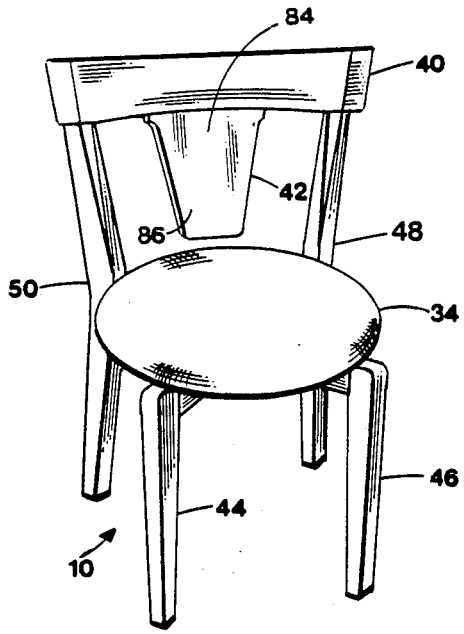
FIG. 1 is a front perspective view of a chair constructed in accordance with the present invention.

10 complete chair
16 h-frame
22 h-frame
28 intermediary plate member
34 seat member
38 backrest assembly
40 horizontal backrest member
42 lower-back-support member
44 front vertical member
46 front vertical member
48 rear vertical member
50 rear vertical member
52 horizontal seat-supporting member
54 horizontal seat-supporting member
56 backrest-assembly dowel
60 rear vertical member bevel
62 machine-screw hole
63 seat locking pin hole

DETAILED DESCRIPTION, FIGS. 1 TO 6

Figure 2:
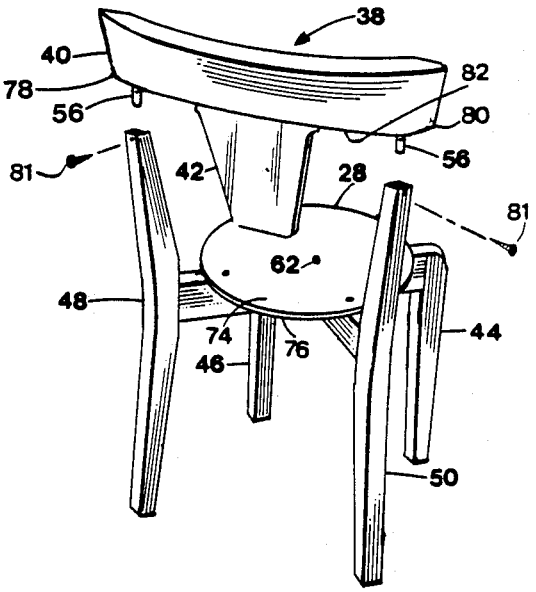
FIG. 2 is a rear perspective of the chair illustrated in FIG. 1, with backrest elevated; seat not shown.
Figure 3:
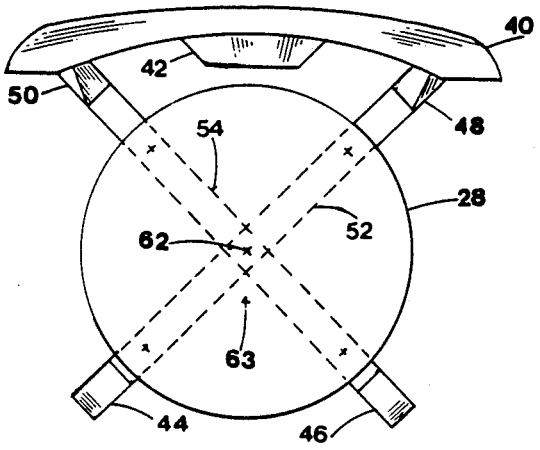
FIG. 3 is a plan view of the chair frame with the intermediary plate and backrest assembly in position but without seat.
Figure 4:
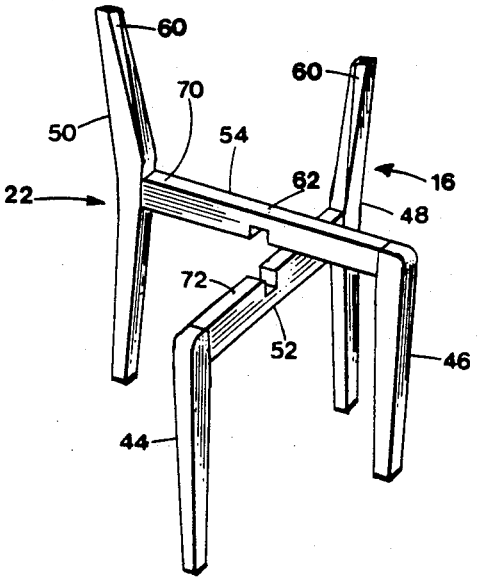
FIG. 4 is a perspective view of the unassembled h-frames and the various elements of which the h-frames are comprised.

Referring now to the drawings, there is disclosed in FIGS. 1–4 a chair designated generally by the reference numeral 10 which is constructed in accordance with the present invention. As shown in FIG. 4, the chair comprises two h-shaped frame assemblies 16 and 22 which inter-connect at right angles at a central joint along their horizontal members 52 and 54 to form an x-shaped support for an intermediary plate 28 (FIG. 2) and seat member 34 (FIG. 1). A backrest assembly 38 is supported by, and joined to, the upper extremities of rear vertical members 48 and 50, as shown in FIGS. 1 and 2.

Figure 5:
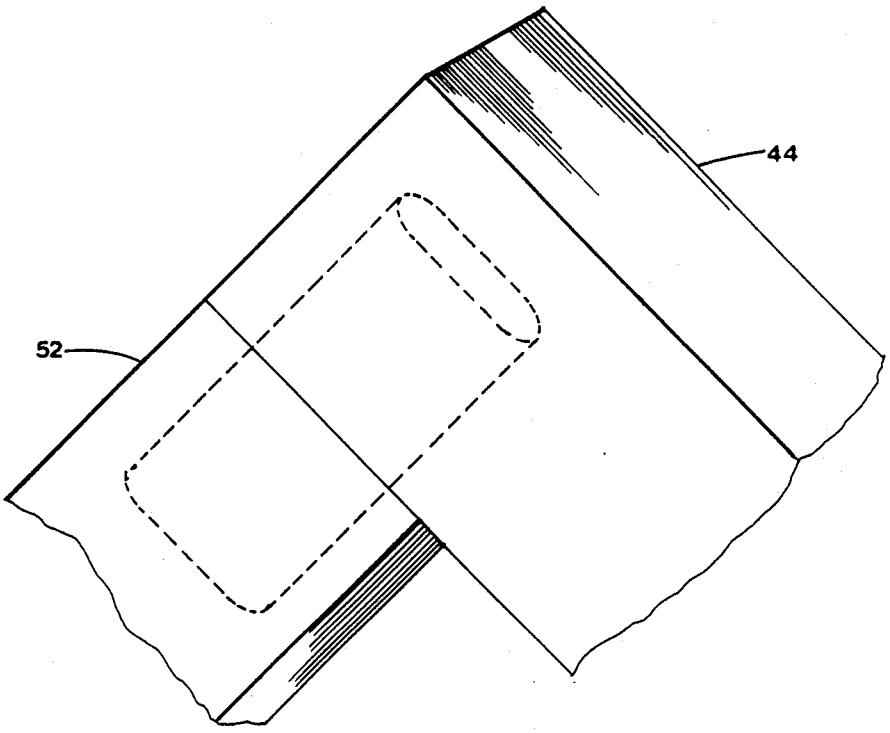
FIG. 5 is a perspective view of a technique for joining vertical with horizontal h-frame members.

More specifically, an h-frame assembly 16 (FIG. 4) is comprised of a front vertical member 44, a rear vertical member 48 and a horizontal seat-supporting member 52. Horizontal member 52 having a top surface 70 forms a right-angle joint at its front-facing end with the upper end of front vertical member 44, as shown in FIGS. 4 and 5. At its rear-facing end, horizontal member 52 forms a right-angle joint generally midway along the inside edge of rear vertical member 48.

An h-frame assembly 22 (FIG. 4) is likewise comprised of a front vertical member 46, a rear vertical member 50 and a horizontal seat-supporting member 54 having a top surface 72. Horizontal member 54 forms a right angle joint at its front-facing end with the upper end of front vertical member 46, as shown in Figure four. At its rear-facing end, horizontal member 54 forms a right-angle joint generally midway along the inside edge of rear vertical member 50.

Horizontal seat-supporting members 52 and 54 are joined to front and rear vertical members 44, 46, 48 and 50 by means of a rigid and permanent joinery technique employed at the place of manufacture. For example, an internal mortise-and-tenon glued joint, as shown in the detail, FIG. 5, may be used whereby corresponding mortises are cut into both vertical and horizontal members. The members are then permanently joined when the appropriately dimensioned tenon is installed with the proper adhesive and the two members are clamped together and the adhesive allowed to dry.

Horizontal seat-supporting member 52 and 54 are further machined to allow the two members to cross approximately at their centerpoints. Specifically, a centrally placed slot extends to the upper edge of horizontal seat-supporting member 52, FIG. 4. Similarly, a centrally located slot extends to the lower edge of horizontal seat-support member 54. The slots are dimensioned and positioned so as to inter-engage each other in a positive joint that is easily facilitated by the assembler. The joint is secured by a machine screw (not pictured) that is driven from the bottom of the horizontal seat-support members through a hole in the exact center of the joint and secured by a threaded fastener installed in a central location in the seat member, as explained below in greater detail.

Thus as h-frame 16 (FIG. 4) is engaged with h-frame 22 at the time of enduser assembly, the chair frame is distinguished by seat-supporting members which form an x, as shown in FIGS. 2, 3 and 4.

Intermediary Plate Member

FIG. 3 shows an intermediary plate member 28 having a top surface 74 and a bottom surface 76 positioned on top of the supporting x-frame. Seat members of prior-art x-frame chairs have been attached to supporting frames with unsightly screw fasteners driven from the tops of the seat members into the frames, or with screws driven from the frame bottoms up into the seats resulting in flimsy construction, or with glue irreversibly joining seat and frames. The intermediary plate of my invention serves to connect and stabilize the supporting frame members in a rigid and solid construction previously unattainable.

Four wood screws, generally approximating ½ cm. in shank diameter and 4 cm. in length, are driven down through prebored holes in intermediary plate member 28 into horizontal seat-supporting members 52 and 54, as shown in FIG. 3, to unitize the chair frame. Plate member 28, fabricated of plywood or other rigid sheet material, has two other prebored holes. A machine-screw hole 62, is bored generally in the center of the plate to acommodate a machine screw, not shown, driven up from the underside of horizontal seat-supporting members 52 and 54 through plate 28 and into seat member 34. A second hole, 63, FIG. 3, acommodates a pin, not shown, which is driven up through plate 28 and into a corresponding hole in the underside of seat member 34.

Seat member 34 has installed in its approximate center a T-nut or other threaded insert having the same diameter as the machine screw, not shown. During assembly seat member 34 is positioned over intermediary-plate member 28 and the machine screw is driven from the underside of the seat-supporting members through plate member 28 and into the threaded hole of seat member 34. When driven tight, this fastener serves as a linchpin to unify all of the interfacing horizontal elements into a strong and rigid assembly. Finally, the seat-locking pin, driven up through hole 63, FIG. 3, and into seat member 34 prevents the seat from revolving on its machine-screw axis. Retraction of the machine screw quickly releases the seat for re-upholstery or refinishing as needed.

Seat member 34 may be fabricated from one of various types of sheet materials or solid wood, and may or may not be covered with upholstery fabric, depending on the buyer's preference.

The h-frame assemblies 16 and 22 are typically constructed of any wood of suitable hardness and strength, and range in thickness from 3 to 4 cm. Front vertical members 44 and 46 and horizontal seat-supporting members 52 and 54 may range from 4 to 6 cm. in width. Front vertical members 44 and 46 may taper to 3 to 4 cm. at their lower extremities. The top front corners of front vertical members 44 and 46 may be rounded over with a radius of approximately 15 mm., FIGS. 1, 2 and 4, though the possibility of radii of greater or lesser length should not be precluded.

Rear vertical members 48 and 50 may assume a graceful concave line from top to bottom. Both rear vertical members 48 and 50 must have their uppermost outside edges chamfered for the sitter's comfort. This shaping of the member results in a bevel, 60, Figure four, of roughly 3 cm. in width beginning at the top of the member and tapering to a point generally near the top of seat member 34.

Backrest Assembly

A backrest assembly 38, FIG. 2, is comprised of a thick, rigid horizontal member 40 and a thinner slightly flexible vertical member 42, which provides comfortable lower-back support for the sitter. The horizontal element must be of sufficient thickness (7 to 8 cm.) and width (7 to 11 cm.) to acommodate dowels 56 (FIG. 2) at each end 78, 80 as well as the central lower-back support 42, all of which project from the bottom surface 82 of horizontal element 40.

FIG. 2 shows two assembled frames 16 and 22 providing support at the upper extremities of their rear vertical members 48 and 50 for backrest assembly 38. The backrest-assembly members are joined to the chair frames by means of an interlocking connection comprised of dowels 56 projecting from the bottom surface of the backrest and nesting in holes of corresponding diameters prebored in the tops of rear vertical members 48 and 50. Once positioned, backrest assembly 38 is securely locked into place with screw fasteners, 81 in FIG. 2 driven through prebored holes in vertical members 48 and 50 and backrest dowels 56, as shown in FIG. 2.

As noted hereinabove, vertical lower-back-support member 42, FIGS. 1 and 2, is designed to provide comfort for the sitter through a combination of support and resilience not found in prior art examples. This is accomplished through a unique combination of factors inherent in the design:

(a) the unrestrained lower end of vertical-support member 42 which allows the member 42 to move in a backwardly direction when pressure is applied by the chair's occupant;

(b) the natural resilience of the wood material of member 42 which allows a degree of flexibility;

(c) the natural resilience of the wood of horizontal backrest member 40 which anchors the upper end of member 42, yet permits a slight movement when pressure is applied;

(d) the upper portions of rear vertical frame members 48 and 50 which impose limits on the sitter's rearward movement, stopping such movement well before damage could result to components of backrest assembly 38.

Vertical lower-back-support member 42 has an upper end 84 and a lower end 86 is typically approximately 1 cm. thick, a size that has proved to be flexible enough to yield slightly to the sitter's backward movement, yet thick enough to preclude fracturing. Because of the forces exerted on the vertical support member, this element is deeply embedded (2½ to 3 cm.) and permanently glued into a slot in horizontal backrest member 40.

Figure 6:
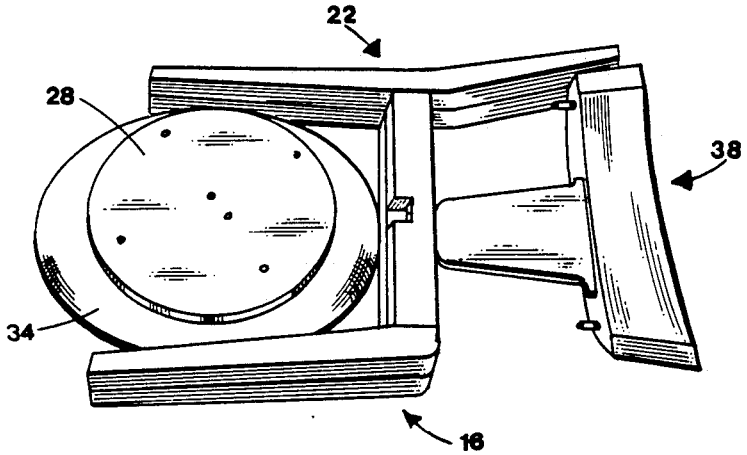
FIG. 6 is a perspective view of the unassembled chair components in a storage mode.

Vertical lower-back-support member 42 may taper slightly from top to bottom as shown in FIGS. 1, 2 and 6, but could assume one of various other shapes. Cavities or incisions may be cut into back-support member 42 for purposes of ornamentation, identification or improved flexibility. Such cuts could assume one of a virtually limitless number of configurations, a crucifix, for example, if the chair is to be used in a church, or a company logo.

FIG. 6 is a perspective view of the unassembled chair components. When two h-frames 16 and 22 are stacked flat, one on the other, a seat and intermediary plate stacked between the frames' legs and the backrest assembly placed in the remaining space, the volume of space occupied by the chair is less than one-fifth of the space required for a fully assembled chair.

Conclusion, Ramifications and Scope of the Invention

Thus it can be seen that the ready-to-assemble chair of this invention offers numerous advantages and improvements:

it can be stored and shipped in a compact package;

its seat can be readily attached to or removed from the frame with the insertion or retraction of a single screw;

its design assures a chair frame well able to withstand the stresses of heavy, prolonged use;

its lower back support is both supportive and resilient;

its appearance is unmarred by exposed fasteners;

it is quickly assembled by an untrained person with a single type of tool.

While my above description contains many specific details, these should not be construed as limitations on the scope of the invention, but rather as an exemplification of one preferred embodiment thereof. Many variations are possible. For example, seats can be shaped in a generally trapezoidal form rather than circular; backrest ends can be rounded rather than angular; frame members can be round or oval in cross-section rather than rectangular; a shelf may be added under the x-frame; casters may be attached to the lower ends of the vertical members; seat-supporting members may be lengthened to allow stacking of the chairs; backrests may be positioned higher or lower, etc.

Accordingly, the scope of the invention should be determined not by the embodiment illustrated, but by the appended claims and their legal equivalents.

I claim:

1. A wood, ready to assemble chair, comprising:

(a) a pair of frame members, each comprised of a shorter front vertical member and a longer rear vertical member joined by a horizontal member having a top surface, said front vertical member, said longer rear vertical member and said horizontal member all being disposed in a common plane and forming the shape of a letter h, said pair of frame members being interconnected at a central point of crossing of each of said horizontal members, thereby defining an angular relationship defined by the letter x;

(b) an intermediary plate of rigid material positioned on said top surface of said horizontal members of said interconnected frame members, said intermediary plate being joined to both of said frame members to thereby form a rigid assembly;

(c) a seat member positioned on and attached to said intermediary plate, said member having a top surface and a bottom surface;

(d) a backrest assembly positioned atop and attached to said longer rear vertical members of said frame members; and (e) a means for joining said backrest assembly to said longer rear vertical members.

2. The ready to assemble chair of claim 1, wherein said intermediary plate of rigid material is provided with prebored holes at spaced intervals through which fasteners are driven to secure said intermediary plate to said horizontal members of said interconnected frame members.

3. The ready to assembly chair of claim 1, wherein said seat member is connected to said intermediary plate by means of a single threaded fastener.

4. The ready to assemble chair of claim 3, wherein each of said horizontal members of said interconnected frame members is provided with a vertically aligned, prebored hole at the approximate point of crossing thereof, and wherein said single threaded fastener is a machine screw which passes vertically upward through said vertically aligned, prebored holes to engage a threaded insert installed in the approximate center of said seat member.

5. The ready to assembly chair of claim 4, wherein a pin is driven through a prebored hole in said intermediary plate, said pin being received within a corresponding hole prebored in said bottom surface of said seat member, thereby preventing said seat member from turning on its axis.

6. The ready to assemble chair of claim 1 wherein said backrest assembly has a bottom surface and opposing ends and wherein said means for joining said backrest assembly to said longer rear vertical members is comprised of dowels projecting downwardly from said bottom surface of said backrest assembly, said dowels being received within prebored holes of corresponding diameters atop said rear vertical members and secured by screw fasteners driven into said rear vertical members and through said dowels.

7. The ready to assemble chair of claim 6, wherein said backrest assembly is comprised of a thick horizontal member from which is suspended a thinner vertical back support member, said vertical member having an upper end which is connected to the bottom surface of said backrest assembly and a lower end, a wherein said lower end is free-floating and spaced-apart from the remainder of said chair, whereby flexible lower back support is provided when a user's back contacts said thinner vertical member.

* * * * *